US007921785B1

(12) United States Patent
Shin

(10) Patent No.: US 7,921,785 B1
(45) Date of Patent: Apr. 12, 2011

(54) FURNITURE WITH FOLDABLE SUPPORT

(76) Inventor: Jeaki Shin, Gyeonggi-do (KR)

( * ) Notice: Subject to any disclaimer, the term of this patent is extended or adjusted under 35 U.S.C. 154(b) by 0 days.

(21) Appl. No.: 12/793,629

(22) Filed: Jun. 3, 2010

(30) Foreign Application Priority Data

Feb. 9, 2010 (KR) ..... 10-2010-0011850

(51) Int. Cl.
*A47B 3/00* (2006.01)

(52) U.S. Cl. ..... 108/132; 248/166; 248/171; 248/439; 108/129

(58) Field of Classification Search ..... 248/157, 248/163.1, 165, 166, 170, 171, 436, 439, 248/440; 108/132, 129, 161
See application file for complete search history.

(56) References Cited

U.S. PATENT DOCUMENTS

| | | | | |
|---|---|---|---|---|
| 6,615,743 | B2 * | 9/2003 | Nien | 108/132 |
| 6,772,700 | B2 * | 8/2004 | Wong | 108/133 |
| 6,971,321 | B1 * | 12/2005 | Strong et al. | 108/133 |
| 7,278,361 | B2 * | 10/2007 | Zhurong et al. | 108/168 |
| 7,533,619 | B2 | 5/2009 | Stanford | |

FOREIGN PATENT DOCUMENTS

KR 20-0428328 10/2006

* cited by examiner

*Primary Examiner* — Anita M King
(74) *Attorney, Agent, or Firm* — Portland IP Law LLC

(57) ABSTRACT

Furniture with a foldable support is provided. The furniture includes a top plate constituting an upper surface of the furniture, a support hinged to support the top plate, a folding part including first and second folding parts hinged to fold the support, and a resilient part for resiliently supporting the second folding part in an unfolding direction. Therefore, it is possible to reduce a volume of the furniture by folding the support into a lower space of the top plate during storage, and improve an unfolding support force of the support by installing the resilient part for applying a resilient force to the folding part upon unfolding of the support.

1 Claim, 3 Drawing Sheets

FURNITURE WITH FOLDABLE SUPPORT

CROSS-REFERENCE TO RELATED APPLICATION

This application claims the benefit under 35 U.S.C. §119 (a) of Korean Patent Application No. 10-2010-0011850, filed on Feb. 9, 2010, the disclosure of which is incorporated herein in its entirety by reference.

BACKGROUND

1. Field

The present invention relates to furniture with a foldable support, and more particularly, to furniture with a foldable support capable of folding the support of the furniture into a lower space of the furniture to reduce a volume of the furniture during storage and movement thereof.

2. Description of the Related Art

In general, since fordable furniture such as foldable chairs, foldable tables, etc. is repeatedly installed and collected due to temporary use in various banquet halls, lecture halls, etc., such foldable furniture is becoming lighter for the convenience of storage and movement, and a space needed for storage and movement is minimized by providing a foldable support to the furniture.

However, such foldable furniture has a complicated structure to cause decrease in assembly performance and productivity of manufacturing the furniture. When an external force is applied to an unfolded support, the support may be unintentionally folded to decrease stability of the furniture.

In order to solve the problem, Korean Utility Model Registration No. 20-0428328, issued on Oct. 12, 2006, discloses an improved foldable table including two foldable bars connected by a link and a spring to provide a resilient force to the foldable bars.

However, in such a conventional foldable table, since the resilient force is applied upon folding of the foldable bars, even when a very small operational force is applied to the unfolded foldable bar, the foldable bar may be folded by the spring so that the table collapses.

In addition, U.S. Pat. No. 7,533,619, issued on May 19, 2009, discloses another foldable table including a fixing ring inserted onto two foldable bars connected by a link to improve an unfolding support force.

However, when a user applies an impact to such a conventional foldable table, the fixing ring press-fitted onto the unfolded foldable bars may be separated due to vibrations of the table so that the foldable bars are folded to collapse the table.

SUMMARY

Accordingly, it is an object of the present invention to provide furniture including a foldable support capable of folding the support to reduce a volume thereof, improving an unfolding support force of the support against an external force, and limiting an internal angle upon unfolding of a folding part and partially overlapping first and second folding parts to improve an unfolding support force.

According to an aspect of the present invention, there is provided furniture with a foldable support including: a top plate constituting an upper surface of the furniture; supports hinged to both ends of a lower surface of the top plate at upper ends thereof to support the top plate; folding parts each including a first folding part hinged to the inside of the support at its one end, and a second folding part hinged to the other end of the first folding part at its one end and hinged to a center of the top plate at the other end; and resilient parts installed at a coupling part between the top plate and the second folding parts to resiliently support the second folding parts in an unfolding direction, wherein a hinge coupling part between the first and second folding parts is spaced apart from the other end of the first folding part such that one end of the second folding part is inserted into a lower part of the other end of the first folding part to support the top plate in a state of contact with the inside of the other end of the first folding part when the folding part is unfolded.

When the folding parts are unfolded, an internal angle $\alpha$ of a hinge coupling part between the first and second folding parts may be 172 to 178°.

Additional aspects of the invention will be set forth in the description which follows, and in part will be apparent from the description, or may be learned by practice of the invention.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION

Figure 1:
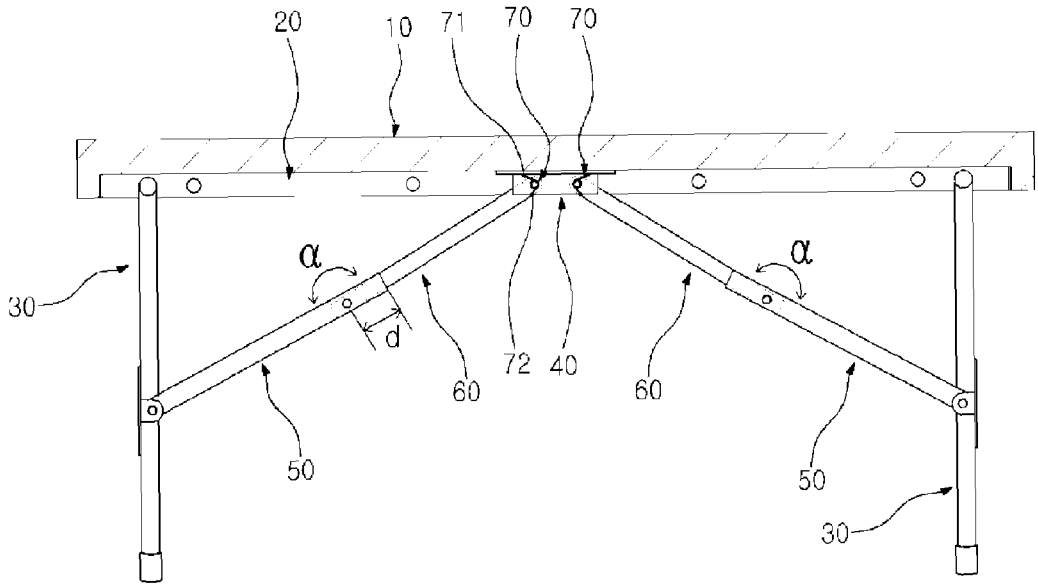
FIG. 1 is a cross-sectional view of furniture with a foldable support in accordance with an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

Figure 2:
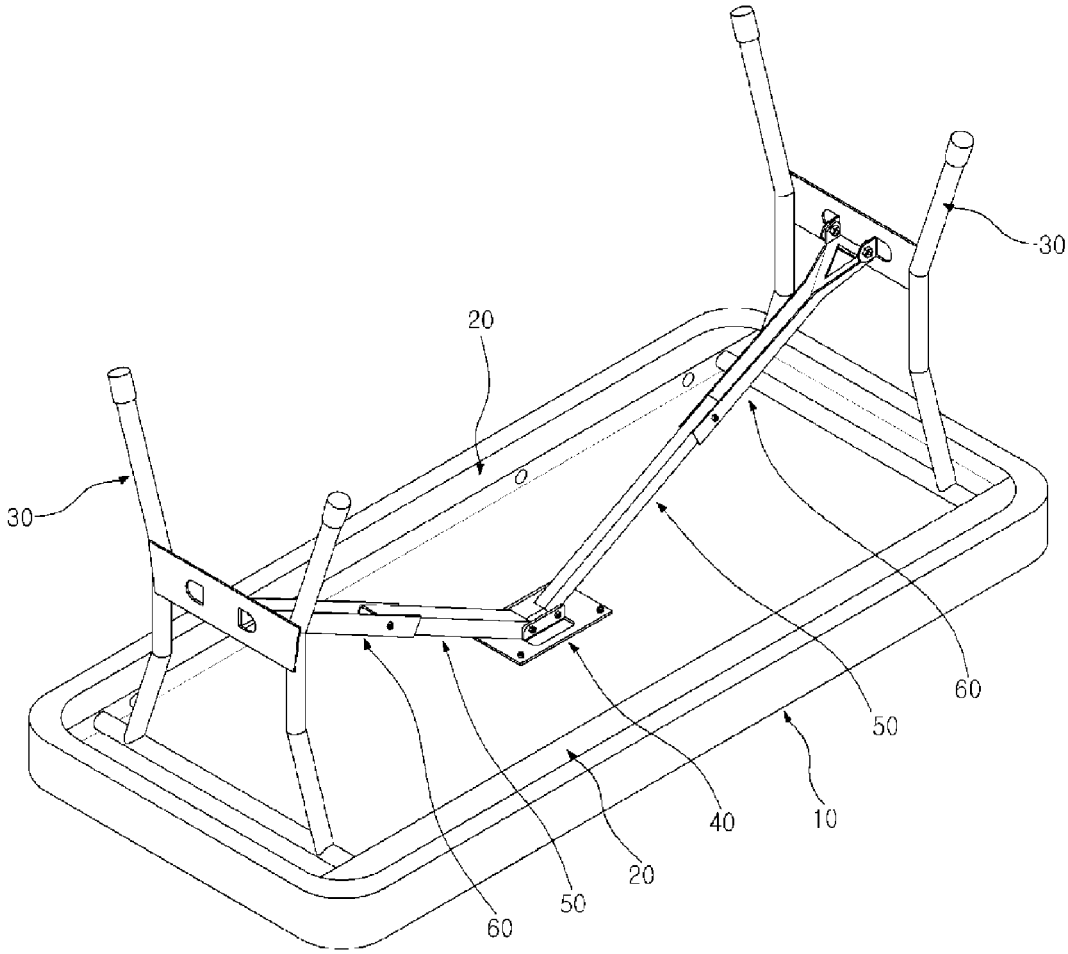
FIG. 2 is a perspective view showing a lower part of the furniture with a foldable support in accordance with an exemplary embodiment of the present invention.
Figure 3:
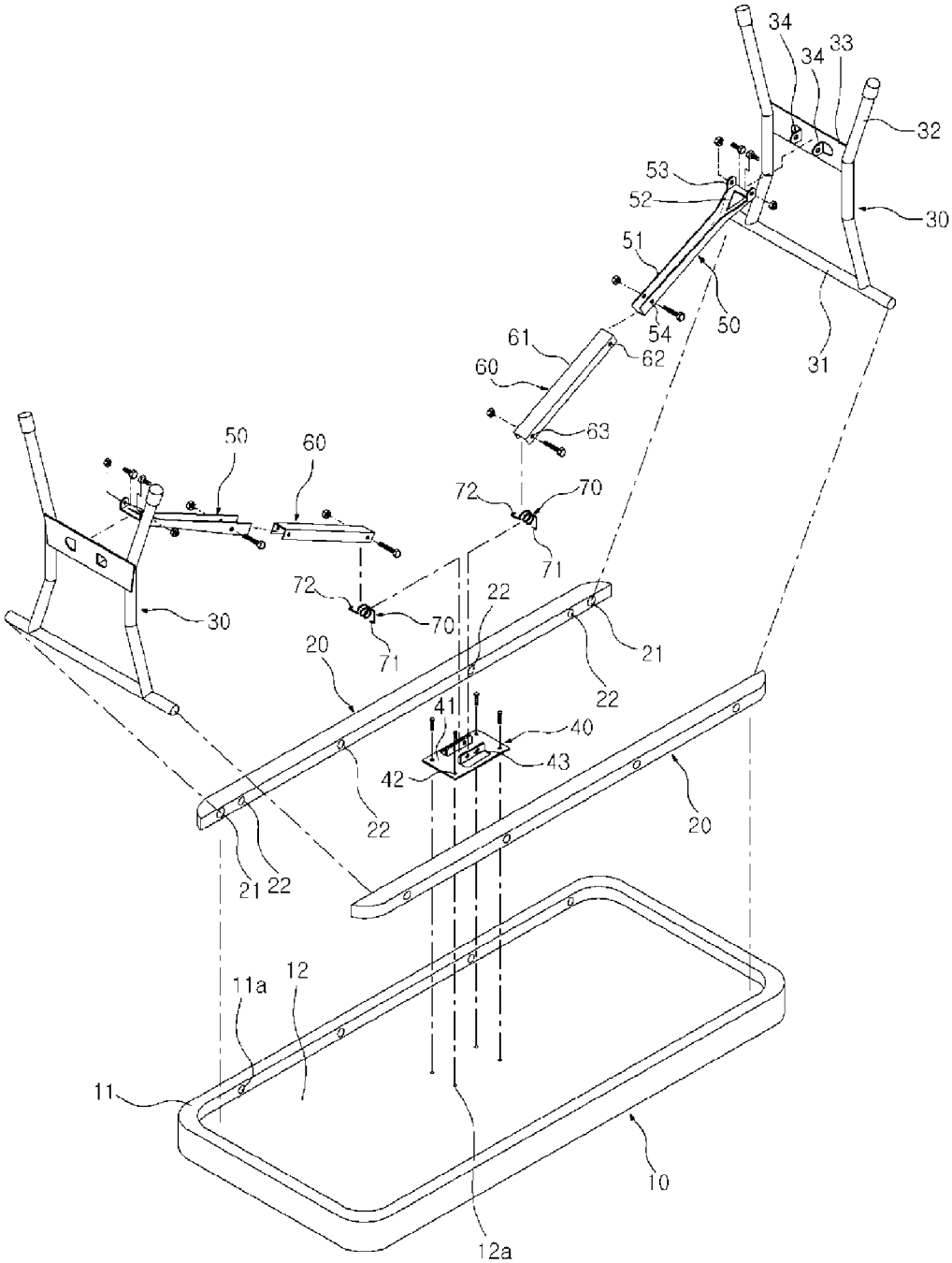
FIG. 3 is an exploded perspective view showing the lower part of the furniture with a foldable support in accordance with an exemplary embodiment of the present invention.

FIG. 1 is a cross-sectional view of furniture with a foldable support in accordance with an exemplary embodiment of the present invention, FIG. 2 is a perspective view showing a lower part of the furniture with a foldable support in accordance with an exemplary embodiment of the present invention, and FIG. 3 is an exploded perspective view showing the lower part of the furniture with a foldable support in accordance with an exemplary embodiment of the present invention.

As shown in FIGS. 1 to 3, furniture with a foldable support in accordance with an exemplary embodiment of the present invention includes a top plate 10, supports 30, folding parts 50 and 60, and resilient parts 70, so that the supports 30 can be folded or unfolded for the purposes of movement and storage of the furniture. The furniture in accordance with an exemplary embodiment of the present invention may be applied as various kinds of foldable furniture such as a foldable table, a foldable chair, etc.

The top plate 10 has a rectangular plate shape to form a top surface of the furniture, and is formed of a synthetic resin material. A lower part of the top plate 10 includes a rim 11 extending from a periphery of the top surface, and a lower surface 12 surrounded by the rim 11 and recessed upward.

In addition, the top plate 10 may have various shapes such as a circular shape, a rectangular shape, etc., and two top plates may be hinged to be folded to reduce a volume thereof during storage. The top plate 10 may be formed of various materials such as iron, wood, etc., in addition to synthetic resin.

A plurality of fixing holes 11*a* are formed in both longitudinal inner sides of the rim 11 of the top plate 10 to install fixing parts 20, and a plurality of coupling holes 12*a* are formed in a center part of the lower surface 12 to install a coupling part 40.

The fixing parts 20 are longitudinal fixing members, and have hinge holes 21 formed in both sides thereof and a plurality of fixing holes 22 in communication with the fixing holes 11*a* formed to be fixed to the rim 11.

The coupling part 40 is a connecting member installed at a center of the lower surface 12 of the top plate 10, to which one ends of the folding parts are hinged to enable rotation of the folding parts. The coupling part 40 includes a plate 41 and a bracket 43.

The plate 41 has a flat shape, has coupling holes 42 formed at its corners to be fixed by a fixing member such as screws, etc., via the coupling holes 12*a* of the lower surface 12.

The bracket 43 may be formed by cutting portions of the plate 41 and bending them upward to oppose each other. The bracket 43 has a plurality of hinge holes formed therein to hinge the folding parts.

The supports 30 are hinged to both ends of the lower surface 12 to vertically support the top plate 10 over the floor, and each of the supports 30 includes a horizontal bar 31, vertical bars 32, a support plate 33, and a support bracket 34.

The horizontal bar 31 is formed of a cylindrical rod, both ends of which are inserted into the hinge holes 21 of the fixing part 20, so that the horizontal bar 31 can be rotated when the support frame 30 is folded or unfolded.

The vertical bars 32 are two support members vertically installed at the horizontal bar 31, which are perpendicularly installed at the top plate 10 to support the weight of the top plate 10. In addition, the both vertical bars 32 are bent inward at their middle parts to increase a vertical load support force against the top plate 10.

Both ends of the support plate 33 are fixed to center parts of one vertical bar 32 and the other vertical bar to connect the both vertical bars 32, further improving a support force of the vertical bars 32.

The support bracket 34 has two parts formed by cutting both center portions of the coupling plate 33 to be opposite to each other and bent inward. The support bracket 34 has hinge holes to be hinged to the folding parts, respectively.

The folding parts 50 and 60 include a first folding part 50 having one end hinged to the support 30, and a second folding part 60 having one end hinged to the other end of the first folding part 50 and the other end hinged to a center of the lower surface 12 of the top plate 10.

The first folding part 50 is hinged to the support bracket 33 of the support 30 at its one end, and includes a support channel 51 and a hinge bracket 53. The support channel 51 has both side surfaces bent upward to form a substantially "C" shape, and punched holes 52 formed in coupling part with the support 30 to reduce its weight.

In addition, the support channel 51 has an enlarged bifurcation part formed at a coupling part of the support 30 to distribute a support load, and hinge holes 54 formed at the other end to hinge the second folding part 60.

The hinge holes 54, which are hinge coupling parts with the second folding part 60, may be spaced apart a predetermined distance from an end of the support channel 51 so that the second folding part 60 partially overlaps the interior of the support channel 51 of the first folding part 50 and is supported by the support channel 51 in a contact state to improve a support force therebetween when the folding parts are unfolded.

A distance d between the hinge holes 54 may be maintained at 3 to 5 cm. This is because, when the distance d is smaller than 3 cm, an overlapping distance between the first and second folding parts 50 and 60 is reduced to lower the support force, and when larger than 5 cm, an overlapping distance between the first and second folding parts 50 and 60 is increased to improve the support force, but manufacturing cost is increased and an internal angle $\alpha$ therebetween is also increased to decrease the unfolding support force upon the unfolding.

The hinge bracket 53 is a connecting member bent inward at both sides of one end of the support panel 51, and has hinge holes formed at a coupling part of the support panel 51 with the support 30 to be hinged to the support bracket 33 of the support 30.

The second folding part 60 has hinge holes 62 and 63 formed at both ends of the support channel 61 such that the second folding part 60 is hinged to the first folding part 50 at its one end, and hinged to the coupling part 40 installed at the lower surface 12 of the top plate 10 at the other end.

The support channel 61 is a channel member bent downward at both sides thereof to form a substantially "C" shape, and may have a width smaller than that of the support panel 51 such that the second folding part 60 is inserted into the support panel 51 when the first and second folding parts 50 and 60 are folded.

In addition, the first and second folding parts 50 and 60 may have an internal angle $\alpha$ formed at a hinge coupling part therebetween upon unfolding to increase an unfolding support force. This is because, when the internal angle $\alpha$ between the first and second folding parts 50 and 60 upon unfolding is smaller than 172°, it is difficult to operate the folding parts from the unfolding to the folding, and when the internal angle $\alpha$ is larger than 178°, an operation from unfolding to folding may be performed even with a small operational force.

In particular, since an optimal unfolding support force is provided when the internal angle $\alpha$ of the hinge coupling part of between the first and second folding parts 50 and 60 is 175°, it is most preferable that the internal angle is 175°.

The resilient part 70 is a resilient member installed at the hinge coupling part between the lower surface 12 of the top plate 10 and the second folding part 60 to resiliently support the folding part in an unfolding direction, and has one support end 71 supported by the lower surface 12 of the top plate 10 and the other support end 72 supported by the support channel 61 of the second folding part 60. The resilient part 70 may be a torsion spring having support ends 71 and 72 projecting form both sides to provide a rotational resilient force.

As described above, the furniture with a foldable support in accordance with an exemplary embodiment of the present invention can fold the support into the lower space of the top plate to reduce a volume of the furniture, improve the unfolding support force of the support by installing the resilient part at the folding part when the support is unfolded, and improve the unfolding support force by limiting the internal angle upon unfolding of the folding part and partially overlapping the first and second folding parts.

As apparent from the above description, the foldable support in accordance with the present invention can be folded into a lower spacer of a top plate to reduce a volume thereof during storage, and a resilient part is installed to provide a resilient force to the folding part when the support is unfolded, thereby improving an unfolding support force of the support against an external force.

The first and second folding parts can partially overlap upon unfolding of the folding parts to improve an unfolding support force. In addition, it is possible to improve an unfolding support force by limiting an internal angle when the folding part is unfolded.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. Furniture with a foldable support comprising:

a top plate constituting an upper surface of the furniture;

supports hinged to both ends of a lower surface of the top plate at upper ends thereof to support the top plate;

folding parts each including a first folding part hinged to the inside of the support at its one end, and a second folding part hinged to the other end of the first folding part at its one end and hinged to a center of the top plate at the other end; and resilient parts installed at a coupling part between the top plate and the second folding part to resiliently support the second folding part in an unfolding direction, wherein a hinge coupling part between the first and second folding parts is spaced apart from the other end of the first folding part such that one end of the second folding part is inserted into a lower part of the other end of the first folding part to support the top plate in contact with the inside of the other end of the first folding part when the folding parts are unfolded, wherein, when the folding parts are unfolded, an internal angle $\alpha$ of the hinge coupling part between the first and second folding parts is 172° to 178°.

* * * * *